US010707546B2

(12) United States Patent
Horiuchi et al.

(10) Patent No.: US 10,707,546 B2
(45) Date of Patent: Jul. 7, 2020

(54) DIELECTRIC FILTER UNIT COMPRISING THREE OR MORE DIELECTRIC BLOCKS AND A TRANSMISSION LINE FOR PROVIDING ELECTROMAGNETICALLY COUPLING AMONG THE DIELECTRIC RESONATORS

(71) Applicant: KYOCERA Corporation, Kyoto (JP)

(72) Inventors: Masafumi Horiuchi, Yokohama (JP); Akio Yamamoto, Kirishima (JP); Hiromichi Yoshikawa, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 15/777,584

(22) PCT Filed: Nov. 18, 2016

(86) PCT No.: PCT/JP2016/004925
§ 371 (c)(1),
(2) Date: May 18, 2018

(87) PCT Pub. No.: WO2017/085936
PCT Pub. Date: May 26, 2017

(65) Prior Publication Data

US 2018/0331405 A1 Nov. 15, 2018

(30) Foreign Application Priority Data

Nov. 20, 2015 (JP) ..... 2015-228227

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/2002* (2013.01); *H01P 5/02* (2013.01);
(Continued)

(58) Field of Classification Search
CPC ..... H01P 1/2053; H01P 7/04
(Continued)

(56) References Cited

U.S. PATENT DOCUMENTS 5,422,612 A * 6/1995 Kobayashi et al. .. H01P 1/2053 333/206
5,883,554 A * 3/1999 Takeuchi et al. ..... H01P 1/2053 333/202
(Continued)

FOREIGN PATENT DOCUMENTS

CN 203826521 U 9/2014
JP H10-229302 A 8/1998
(Continued)

*Primary Examiner* — Benny T Lee
(74) *Attorney, Agent, or Firm* — Studebaker & Brackett PC

(57) ABSTRACT

A dielectric filter unit includes three or more dielectric blocks including a first dielectric block and a second dielectric block and arranged in a predetermined direction, and a transmission line. The three or more dielectric blocks include at least one dielectric block between the first dielectric block and the second dielectric block. Each of the three or more dielectric blocks is electromagnetically coupled to one or two adjacent dielectric blocks included in the three or more dielectric blocks. The transmission line is electromagnetically coupled to the first dielectric block and the second dielectric block.

18 Claims, 11 Drawing Sheets

(51) Int. Cl.
*H01P 1/20* (2006.01)
*H01P 5/02* (2006.01)
*H01P 7/10* (2006.01)

(52) U.S. Cl.
CPC ..... *H01P 5/022* (2013.01); *H01P 7/04* (2013.01); *H01P 7/10* (2013.01)

(58) Field of Classification Search
USPC ..... 333/206
See application file for complete search history.

(56) References Cited

U.S. PATENT DOCUMENTS

| | | | | |
|---|---|---|---|---|
| 5,977,848 | A * | 11/1999 | Nakaguchi et al. .. | H01P 1/2136 333/206 |
| 6,016,091 | A | 1/2000 | Hidaka et al. | |
| 6,243,564 | B1 * | 6/2001 | Yorita ..... | H01P 1/2053 333/134 |
| 6,275,125 | B1 * | 8/2001 | Takei et al. ..... | H01P 1/2053 333/206 |
| 6,498,550 | B1 | 12/2002 | Miller et al. | |
| 2015/0091672 | A1 | 4/2015 | Subedi et al. | |

FOREIGN PATENT DOCUMENTS

| | | | |
|---|---|---|---|
| JP | 2000-077907 | A | 3/2000 |
| JP | 2000-134004 | A | 5/2000 |
| JP | 2002-246808 | A | 8/2002 |
| WO | 02/078119 | A1 | 10/2002 |

* cited by examiner

DIELECTRIC FILTER UNIT COMPRISING THREE OR MORE DIELECTRIC BLOCKS AND A TRANSMISSION LINE FOR PROVIDING ELECTROMAGNETICALLY COUPLING AMONG THE DIELECTRIC RESONATORS

CROSS-REFERENCE TO RELATED APPLICATIONS

This application claims priority to Japanese Patent Application No. 2015-228227 filed on Nov. 20, 2015 in Japan, the entire disclosure of which is hereby incorporated by reference herein.

FIELD

The present disclosure relates to a dielectric filter unit and a communication device.

BACKGROUND

A dielectric filter including a dielectric resonator is known (refer to, for example, Patent Literature 1). The dielectric resonator includes a dielectric block having a planar portion, and generates a transverse magnetic (TM) mode resonance having an electric field component in a direction perpendicular to the planar portion inside the dielectric block. The dielectric filter desirably has a broad signal passband width is stable.

CITATION LIST

Patent Literature

Patent Literature 1: Japanese Patent Application Publication No. 10-229302

SUMMARY

A dielectric filter unit according to one embodiment of the present disclosure includes three or more dielectric blocks including a first dielectric block and a second dielectric block and arranged in a predetermined direction, and a transmission line. The three or more dielectric blocks include at least one dielectric block between the first dielectric block and the second dielectric block. Each of the three or more dielectric blocks is electromagnetically coupled to one or two adjacent dielectric blocks included in the three or more dielectric blocks. The transmission line is electromagnetically coupled to the first dielectric block and the second dielectric block.

A communication device according to one embodiment of the present disclosure includes a dielectric filter unit including three or more dielectric blocks including a first dielectric block and a second dielectric block and arranged in a predetermined direction, and a transmission line. The three or more dielectric blocks include at least one dielectric block between the first dielectric block and the second dielectric block. Each of the three or more dielectric blocks is electromagnetically coupled to one or two adjacent dielectric blocks included in the three or more dielectric blocks. The transmission line is electromagnetically coupled to the first dielectric block and the second dielectric block.

DETAILED DESCRIPTION

Figure 1:
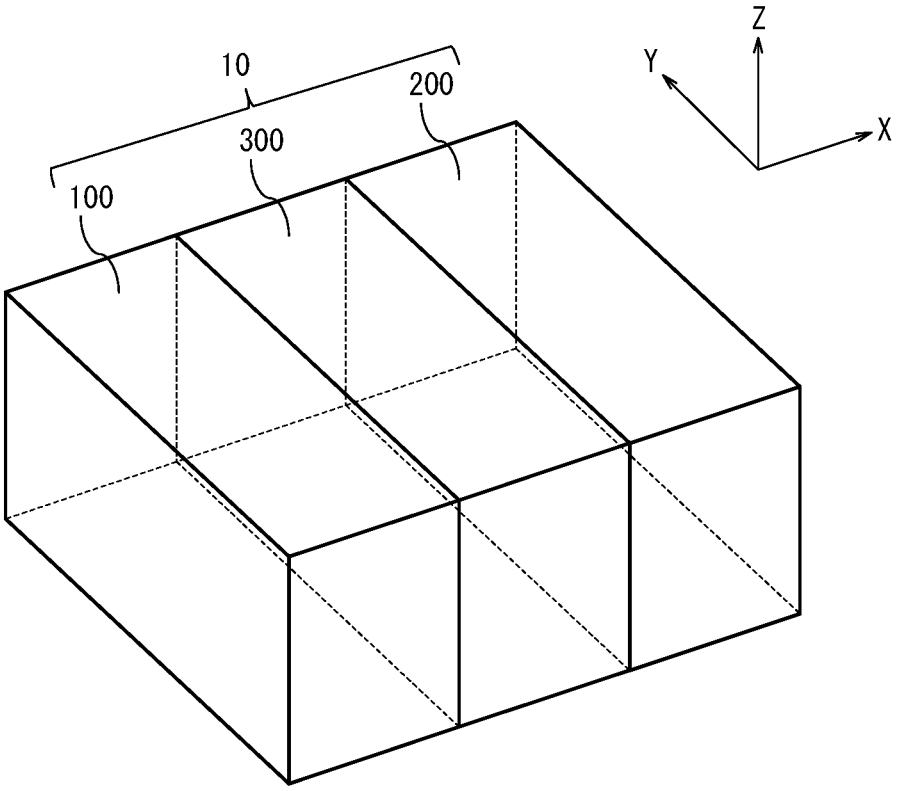
FIG. 1 is a perspective view of a dielectric filter according to one embodiment.

As shown in FIG. 1, a dielectric filter 10 according to one embodiment includes a first dielectric block 100, a second dielectric block 200, and a third dielectric block 300. The first dielectric block 100, the second dielectric block 200, and the third dielectric block 300 are arranged side by side in X-direction. The third dielectric block 300 is located between the first dielectric block 100 and the second dielectric block 200.

The first dielectric block 100, the second dielectric block 200, and the third dielectric block 300 will also be simply referred to as the "dielectric blocks". In the present embodiment, the dielectric blocks are substantially rectangular prisms. The dielectric blocks may not be substantially rectangular prisms. The dielectric blocks may be polyhedrons. The dielectric blocks may be solids each having at least a portion surrounded by a curved surface. In the example shown in FIG. 1, each dielectric block has the same lengths in X-, Y-, and Z-directions as the other dielectric blocks. Each dielectric block may have lengths different from the lengths in the corresponding directions of the other dielectric blocks.

Figure 2:
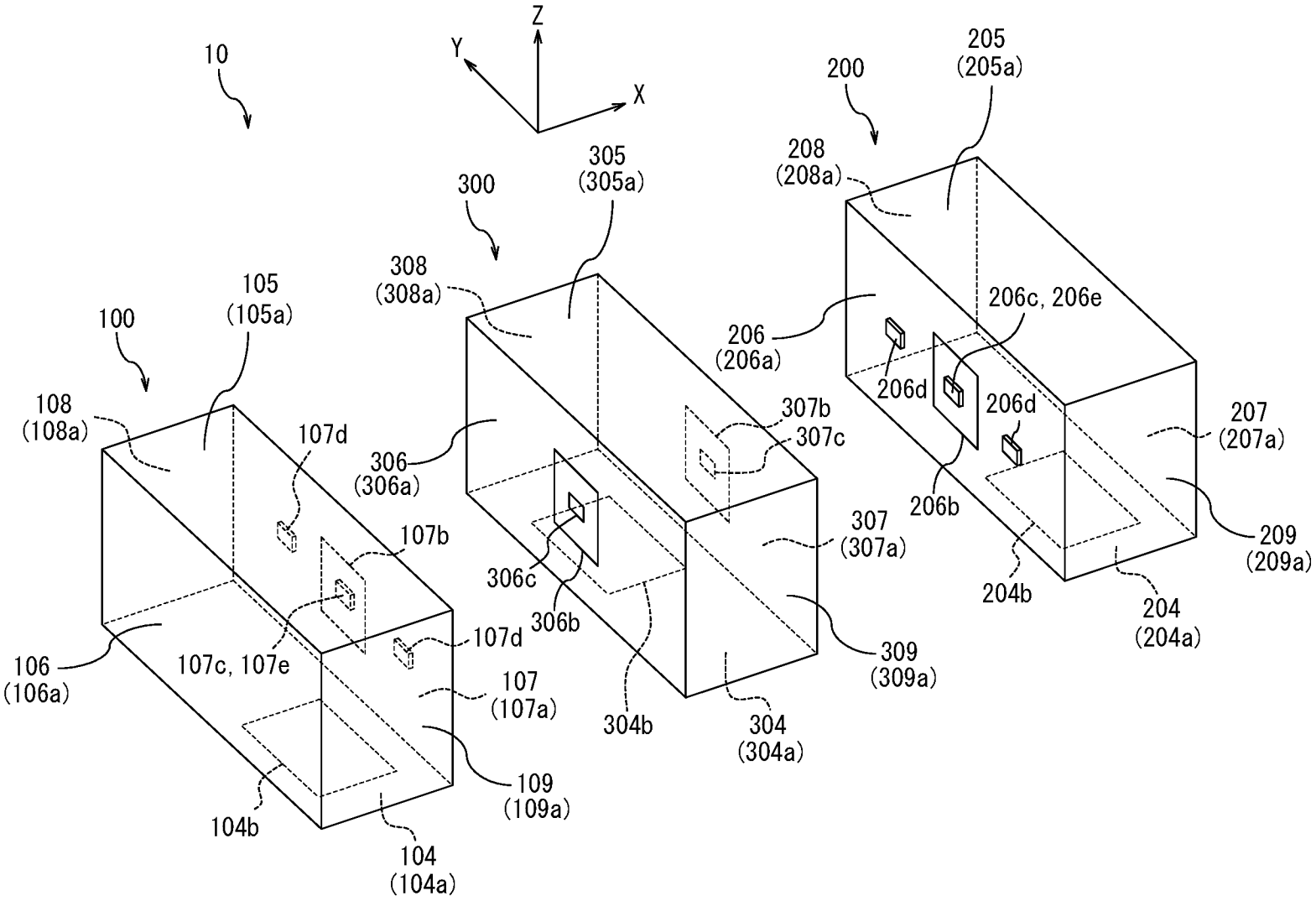
FIG. 2 is an exploded perspective view of the dielectric filter shown in FIG. 1.

As shown in FIG. 2, each dielectric block has six faces. It is noted that any of the reference characters shown in the drawings not explicitly identified in the following paragraphs are identified in the Reference signs list at the end of this specification. The first dielectric block 100 has a first face 104 at one position along the Z-direction, and a second face 105 in another position along the Z-direction. The first dielectric block 100 has a third face 106 at one position along the X-direction, and a fourth face 107 at another position along the X-direction. The first dielectric block 100 has a fifth face 108 at one position along the Y-direction, and a sixth face 109 at another position along the Y-direction. The second dielectric block 200 has a first face 204 at one position along the Z-direction, and a second face 205 at another position along the Z-direction. The second dielectric block 200 has a third face 206 at one position along the X-direction, and a fourth face 207 at another position along the X-direction. The second dielectric block 200 has a fifth face 208 at one position along the Y-direction, and a sixth face 209 at another position along the Y-direction. The third dielectric block 300 has a first face 304 at one position along the Z-direction, and a second face 305 at another position along the Z-direction. The third dielectric block 300 has a third face 306 at one position along the X-direction, and a fourth face 307 at another position along the X-direction. The third dielectric block 300 has a fifth face 308 at one position along the Y-direction, and a sixth face 309 at another position along the Y-direction.

Each dielectric block includes a dielectric base, and a conductive layer located on each face of the dielectric base. The dielectric base may be formed from a dielectric material such as dielectric ceramics. The dielectric material may be a dielectric ceramic material containing, for example, $BaTiO_3$, $Pb_4Fe_2Nb_2O_{12}$, or $TiO_2$. The dielectric material may not be dielectric ceramics, and may be, for example, a resin material such as an epoxy resin. The dielectric material may have a high relative dielectric constant. The relative dielectric constant may be, for example, 70 or greater. The dielectric material may have characteristics including resonance frequency that are less likely to be affected by temperature changes.

The conductive layer may be, for example, a thin metal film. The conductive layer may not be a metal, and may contain various other conductive materials including non-metal conductive materials. The conductive material may mainly contain Ag or an Ag-alloy, such as Ag—Pd or Ag—Pt. The conductive material may be a Cu-based, W-based, Mo-based, or Pd-based conductive material. The conductive layer may be, for example, a metallization material used to metalize a dielectric block, such as Ag metallization. The conductive layer may be formed with methods including printing and firing, deposition, physical vapor deposition (PVD), and chemical vapor deposition (CVD).

The dielectric block includes the dielectric base having the conductive layer on each face. Each conductive layer is denoted with letter a added to the reference sign indicating the corresponding face. For example, the first dielectric block 100 has the first face 104 having a conductive layer 104*a*. The dielectric blocks have the faces having the conductive layers that electrically communicate with one another. When at least one of the conductive layers is grounded, the conductive layer of each face will have a ground potential.

The first dielectric block 100 has a conductive layer 107*a* with an opening 107*b* on the fourth face 107. The first dielectric block 100 has a connecting conductive layer 107*c* on a portion of the fourth face 107 inside the opening 107*b*. The second dielectric block 200 has a conductive layer 206*a* with an opening 206*b* on the third face 206. The second dielectric block 200 has a connecting conductive layer 206*c* on a portion of the third face 206 inside the opening 206*b*. The third dielectric block 300 has a conductive layer 306*a* on the third face 306, and a conductive layer 307*a* on the third face 307. The conductive layer 306*a* has an opening 306*b*. The conductive layer 307*a* has an opening 307*b*. The third dielectric block 300 has a connecting conductive layer 306*c* on a portion of the third face 306 inside the opening 306*b*, and a connecting conductive layer 307*c* on a portion of the third face 307 inside the opening 307*b*. The connecting conductive layers 107*c*, 206*c*, 306*c*, and 307*c* are each located at a predetermined distance from the corresponding conductive layers 107*a*, 206*a*, 306*a*, and 307*a*. The connecting conductive layers 107*c*, 206*c*, 306*c*, and 307*c* do not electrically communicate with the corresponding conductive layers 107*a*, 206*a*, 306*a*, and 307*a*. The predetermined distance between the connecting conductive layer 107*c* and the conductive layer 107*a* is determined to prevent the connecting conductive layer 107*c* from electrically communicating with the conductive layer 107*a* with positioning errors during manufacture. Likewise, the predetermined distance between the connecting conductive layer 206*c* and the conductive layer 206*a*, between the connecting conductive layer 306*c* and the conductive layer 306*a*, and between the connecting conductive layer 307*c* and the conductive layer 307*a* is determined to permit positioning errors during manufacture. The connecting conductive layers may be formed in the same manner as the conductive layers. The connecting conductive layers may be, for example, metal thin films. The connecting conductive layer may not be metal, and may contain various other conductive materials including non-metal conductive materials. The conductive material may mainly contain Ag or an Ag-alloy, such as Ag—Pd or Ag—Pt. The conductive material may be a Cu-based, W-based, Mo-based, or Pd-based conductive material. The conductive layer may be, for example, a metallization material used to metalize a dielectric block, such as Ag metallization. The conductive layer may be formed with methods including printing and firing, deposition, PVD, and CVD.

For the first dielectric block 100 and the third dielectric block 300, the opening 107*b* and the opening 306*b*, respectively, face each other. For the first dielectric block 100 and the third dielectric block 300, the connecting conductive layer 107*c* and the connecting conductive layer 306*c*, respectively, electrically communicate with each other. For the second dielectric block 200 and the third dielectric block 300, the opening 206*b* and the opening 307*b*, respectively, face each other. For the second dielectric block 200 and the third dielectric block 300, the connecting conductive layer 206*c* and the connecting conductive layer 307*c*, respectively, electrically communicate with each other. The connecting conductive layer 107*c* and the connecting conductive layer 306*c* are electrically connected through connection member 107*e*. The connecting conductive layer 206*c* and the connecting conductive layer 307*c* are electrically connected through connection member 206*e*. The connection members 107*d* and 206*d* may be solder. The connecting conductive layer 107*c* and the connecting conductive layer 306*c*, and the connecting conductive layer 206*c* and the connecting conductive layer 307*c* may be bonded with each other using materials other than solder. The connecting conductive layer 107*c* and the connecting conductive layer 306*c*, and the connecting conductive layer 206*c* and the connecting conductive layer 307*c* may be electrically bonded using, for example, an electrically conductive adhesive or an electrically conductive double-sided tape. The electrical connection between the connecting conductive layers 107*c* and 306*c*, and the electrical connection between the connecting conductive layers 206*c* and 307*c* can permit positioning errors during manufacture between the dielectric blocks. The electrical insulation between the connecting conductive layer 107*c* and the conductive layer 306*a*, the electrical insulation between the connecting conductive layer 206*c* and the conductive layer 307*a*, the electrical insulation between the connecting conductive layer 306*c* and the conductive layer 107*a*, and the electrical insulation between the connecting conductive layer 307*c* and the conductive layer 206*a* can permit positioning errors during manufacture between the dielectric blocks. The facing openings 107*b* and 306*b*, and the facing openings 206*b* and 307*b* can permit positioning errors during manufacture between the dielectric blocks.

The first dielectric block 100 and the third dielectric block 300 are electromagnetically coupled to each other. The connecting conductive layer 107*c* and the connecting conductive layer 306*c* electrically communicating with each other can further strengthen the coupling between the first dielectric block 100 and the third dielectric block 300. The second dielectric block 200 and the third dielectric block 300 are electromagnetically coupled to each other. The connecting conductive layer 206*c* and the connecting conductive layer 307*c* electrically communicating with each other can further strengthen the coupling between the second dielectric block 200 and the third dielectric block 300. The dielectric blocks are capacitively coupled dominantly rather than inductively coupled.

The conductive layer 107*a* and the conductive layer 306*a* can directly electrically communicate with each other. The conductive layer 107*a* and the conductive layer 306*a* can be at least partially bonded using, for example, solder. The conductive layer 107*a* and the conductive layer 306*a* can be bonded using other materials such as an electrically conductive adhesive or an electrical conductivity double-sided tape. The conductive layer 107*a* and the conductive layer 306*a* can be joined together using a mechanical connection member such as screws or bolts. The conductive layer 107*a* and the conductive layer 306*a* can be joined together using at least one connection member 107*d*. The connection members 107*d* are located, for example, at a predetermined distance from the openings 107*b* and 306*b* at different positions along the Y-direction. The connection members 107*d* may not be located in this manner, and may be located in any other part of the conductive layer 107*a*. The connection members 107*d* may extend across the entire conductive layer 107*a*. The connection members 107*d* may not be located on the fourth face 107, and may be located on the third face 306. The connection members 107*d* can thus be equivalent to the connection members 306*d* on the third face 306.

The conductive layer 206*a* and the conductive layer 307*a* can directly electrically communicate with each other. The conductive layer 206*a* and the conductive layer 307*a* can be at least partially bonded using, for example, solder. The conductive layer 206*a* and the conductive layer 307*a* can be bonded using other materials such as an electrically conductive adhesive or an electrical conductivity double-sided tape. The conductive layer 206*a* and the conductive layer 307*a* can be joined together using a mechanical connection member such as screws or bolts. The conductive layer 206*a* and the conductive layer 307*a* can be bonded together using at least one connection member 206*d*. The connection members 206*d* are located, for example, at a predetermined distance from the openings 206*b* and 307*b* at different positions along the Y-direction. The connection members 206*d* may not be located in this manner, and may be located in any other part of the conductive layer 206*a*. The connection members 206*d* may extend across the entire conductive layer 206*a*. The connection members 206*d* may not be located on the third face 206, and may be located on the fourth face 307. The connection members 206*d* can thus be equivalent to the connection members 307*d* on the fourth face 307.

The first dielectric block 100 and the third dielectric block 300 are mechanically joined using the connection members 107*d*. The conductive layer 107*a* and the conductive layer 306*a* mechanically joined together further strengthen the mechanical coupling between the first dielectric block 100 and the third dielectric block 300. The second dielectric block 200 and the third dielectric block 300 are mechanically joined using the connection members 206*d*. The conductive layer 206*a* and the conductive layer 307*a* mechanically joined together further strengthen the mechanical coupling between the second dielectric block 200 and the third dielectric block 300. The conductive layer of the first dielectric block 100 and the conductive layer of the third dielectric block 300 electrically communicate with each other through the connection members 107*d*. The conductive layer of the second dielectric block 200 and the conductive layer of the third dielectric block 300 electrically communicate with each other through the connection members 206*d*. The conductive layer of the first dielectric block 100, the conductive layer of the third dielectric block 300, and the conductive layer of the second dielectric block 200 electrically communicating with one another can further electrically stabilize the dielectric filter 10.

The first dielectric block 100 has the first face 104 having a conductive layer 104*a* with an opening 104*b*. The second dielectric block 200 has the first face 204 having a conductive layer 204*a* with an opening 204*b*. The third dielectric block 300 has the first face 304 having a conductive layer 304*a* with an opening 304*b*. The dielectric filter 10 receives signals through the opening 104*b*. The opening 104*b* will also be referred to as a first opening, through which an input signal passes. The conductive layer 104*a* with the opening 104*b* will also be referred to as a first conductive layer. The signals input into the first dielectric block 100 propagate through the third dielectric block 300 to the second dielectric block 200. The signals reaching the second dielectric block 200 are output through the opening 204*b*. The opening 204*b* will also be referred to as a second opening, through which an output signal passes. The conductive layer 204*a* with the opening 204*b* will also be referred to as a second conductive layer. Signals are transmitted through the dielectric blocks with the transmittance determined by the resonance characteristics of the blocks. In other words, the transmittance of the dielectric filter 10 has frequency characteristics corresponding to the resonance characteristics of the respective dielectric blocks. As described later, the opening 304*b* affects the frequency characteristics of the transmittance of the dielectric filter 10. The opening 304*b* will also be referred to as a fifth opening. The conductive layer 304*a* with the opening 304*b* will also be referred to as a third conductive layer. Signals may be input through the opening 204*b* and output through the opening 104*b*.

Figure 3:
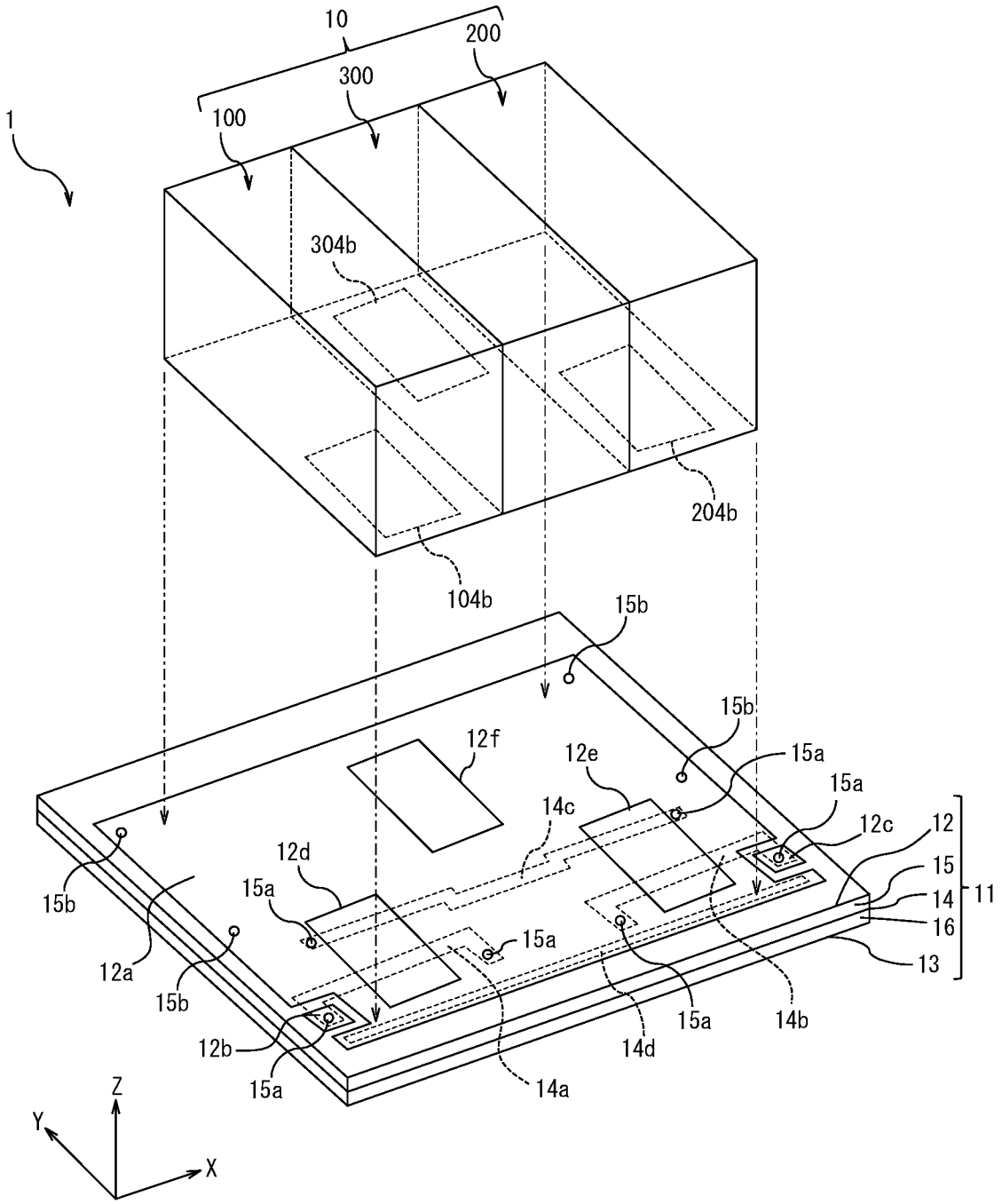
FIG. 3 is an exploded perspective view of a dielectric filter unit according to one embodiment.

As shown in FIG. 3, the dielectric filter unit 1 includes the dielectric filter 10 and a substrate 11. The substrate 11 includes a first substrate 15 and a second substrate 16. The first substrate 15 has a first substrate surface 12 at one position along the Z-direction. The second substrate 16 has a second substrate surface 13 at another position along the Z-direction. The substrate 11 has an intermediate surface 14 between the first substrate 15 and the second substrate 16. The first substrate 15 and the second substrate 16 may be formed from a dielectric material. The first substrate 15 and the second substrate 16 may be formed from an organic material. The organic material may have a relative dielectric constant of about 4. The first substrate 15 has the circuit patterns on the first substrate surface 12 spaced from the circuit patterns on the intermediate surface 14. The second substrate 16 has the circuit patterns on the second substrate surface 13 spaced from the circuit patterns on the intermediate surface 14.

Figure 4:
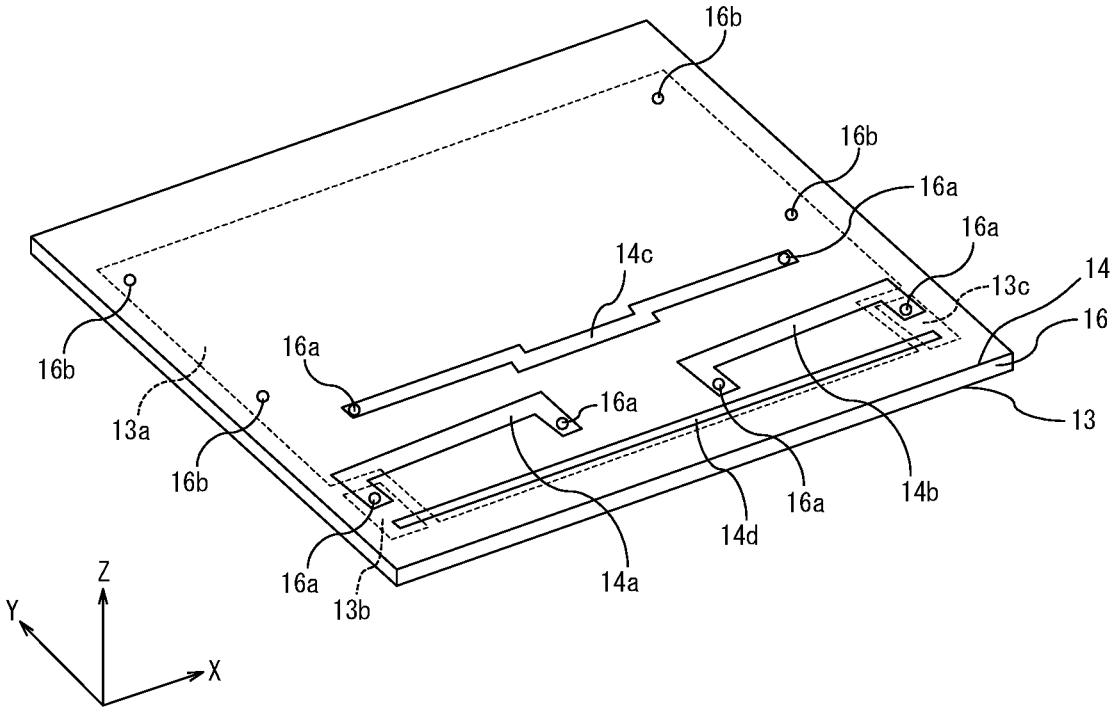
FIG. 4 is a perspective view of patterns on an intermediate surface and a second substrate surface of the substrate shown in FIG. 3.

The first substrate 15 has vias 15*a* and 15*b*. The second substrate 16 has vias 16*a* and 16*b* (refer to FIG. 4). The vias 15*a* allow electrical communication between the conductors of the circuit patterns on the first substrate surface 12 and the conductors of the circuit patterns on the intermediate surface 14. The vias 16*a* allow electrical communication between the conductors of the circuit patterns on the second substrate surface 13 and the conductors of the circuit patterns on the intermediate surface 14 as shown in FIG. 4. The vias 15*b* and 16*b* electrically communicate with each other. The vias 15*b* and 16*b* allow electrical communication between the conductors on the first substrate surface 12 and the conductors on the second substrate surface 13. The vias 15*a*, 15*b*, 16*a*, and 16*b* may be formed from various conductive materials including metal or non-metal conductive materials. The vias 15*a*, 15*b*, 16*a*, and 16*b* may be formed by, for example, Cu embedded in the substrates. The vias 15*a*, 15*b*, 16*a*, and 16*b* may be formed with other methods. The conductors of the circuit patterns may be formed from various conductive materials including metal or non-metal conductive materials. The conductors of the circuit patterns may be copper films.

The first substrate surface 12 has the circuit patterns on it. In FIG. 3, for example, solid lines indicate the circuit patterns on the first substrate surface 12. The first substrate surface 12 has the circuit patterns including a 11th pattern 12*a*, a 12th pattern 12*b*, and a 13th pattern 12*c*. The 11th pattern 12*a* is to be electrically connected to the ground (GND) of the circuit to be mounted. The 11th pattern 12*a* has openings 12*d*, 12*e*, and 12*f*. The openings 12*d*, 12*e*, and 12*f* face the corresponding openings 104*b*, 204*b*, and 304*b* in the dielectric filter 10. The 11th pattern 12*a* is separated from the 12th pattern 12*b* and the 13th pattern 12*c* on the first substrate surface 12.

The intermediate surface 14 has the circuit patterns thereon. The circuit patterns on the intermediate surface 14 are indicated with, for example, broken lines in FIG. 3, and with solid lines in FIG. 4. The intermediate surface 14 has the circuit patterns including a 31st pattern 14*a*, a 32nd pattern 14*b*, a 33rd pattern 14*c*, and a 34th pattern 14*d*. The 31st pattern 14*a* to the 34th pattern 14*d* will also be referred to as transmission lines. The 31st pattern 14*a* will also be referred to as an input line. The 32nd pattern 14*b* will also be referred to as an output line. The 33rd pattern 14*c* will also be referred to as a first skip-connecting line. The 34th pattern 14*d* will also be referred to as a second skip-connecting line. The 31st pattern 14*a* can be partially electromagnetically coupled to the first dielectric block 100 through the openings 12*d* and 104*b*. The 32nd pattern 14*b* can be partially electromagnetically coupled to the second dielectric block 200 through the openings 12*e* and 204*b*. The 33rd pattern 14*c* can be partially electromagnetically coupled to the first dielectric block 100 through the openings 12*d* and 104*b*. The 33rd pattern 14*c* can be partially electromagnetically coupled to the second dielectric block 200 through the openings 12*e* and 204*b*. The dielectric filter 10 can be partially connected to the transmission lines through the openings 104*b* and 204*b*. The transmission lines are inductively coupled dominantly to the dielectric blocks rather than inductively coupled.

The 31st pattern 14*a* has a first end electrically communicating with the 11th pattern 12*a* through the via 15*a*. The 31st pattern 14*a* has a second end electrically communicating with the 12th pattern 12*b* through the via 15*a*. The 32nd pattern 14*b* has a first end electrically communicating with the 11th pattern 12*a* through the via 15*a*. The 32nd pattern 14*b* has a second end electrically communicating with the 13th pattern 12*c* through the via 15*a*. The 33rd pattern 14*c* has both ends electrically communicating with the 11th pattern 12*a* through the vias 15*a*. The 34th pattern 14*d* faces the 11th pattern 12*a* across the first substrate 15, but does not electrically communicate with the 11th pattern 12*a*.

The second substrate surface 13 has the circuit patterns. In FIG. 4, for example, broken lines indicate the circuit patterns on the second substrate surface 13. The second substrate surface 13 has a 21st pattern 13*a*, a 22nd pattern 13*b*, and a 23rd pattern 13*c*. The 21st pattern 13*a* is to be electrically connected to the ground (GND) of the circuit to be mounted. The 31st pattern 14*a*, the 32nd pattern 14*b*, the 33rd pattern 14*c*, and the 34th pattern 14*d* are located on the intermediate surface 14. In FIG. 4, solid lines indicate the 31st pattern 14*a*, the 32nd pattern 14*b*, the 33rd pattern 14*c*, and the 34th pattern 14*d*.

The 31st pattern 14*a* has the first end electrically communicating with the 21st pattern 13*a* through the via 16*a*. The 31st pattern 14*a* has the second end electrically communicating with the 22nd pattern 13*b* through the via 16*a*. The 32nd pattern 14*b* has the first end electrically communicating with the 21st pattern 13*a* through the via 16*a*. The 32nd pattern 14*b* has the second end electrically communicating with the 23rd pattern 13*c* through the via 16*a*. The 33rd pattern 14*c* has both the ends electrically communicating with the 21st pattern 13*a* through the vias 16*a*. The 34th pattern 14*d* partially faces the 21st pattern 13*a* across the second substrate 16, but does not electrically communicate with the 21st pattern 13*a*. The 34th pattern 14*d* has a first end facing the 22nd pattern 13*b* across the second substrate 16. The 22nd pattern 13*b* is electromagnetically coupled to the first end of the 34th pattern 14*d*. The 34th pattern 14*d* has a second end facing the 23rd pattern 13*c* across the second substrate 16. The second end of the 34th pattern 14*d* is electromagnetically coupled to the 23rd pattern 13*c*. The 34th pattern 14*d* and the 22nd pattern 13*b*, as well as the 34th pattern 14*d* and the 23rd pattern 13*c* are capacitively coupled dominantly rather than inductively coupled.

The vias 15*b* of the first substrate 15 electrically communicate with the vias 16*b* of the second substrate 16. The 11th pattern 12*a* of the first substrate surface 12 and the 21st pattern 13*a* of the second substrate surface 13 electrically communicate with each other through the vias 15*b* and 16*b*. The vias 15*b* and 16*b* may not be four vias, and may be three or fewer vias, or five or more vias. The vias 15*b* and 16*b* may not be located as shown in FIGS. 3 and 4, and may be located in any other manner.

The 31st pattern 14*a* has the first end grounded through the via 16*a* and the 21st pattern 13*a* of the second substrate surface 13. The 32nd pattern 14*b* has the first end grounded through the via 16*a* and the 21st pattern 13*a* of the second substrate surface 13. The first end of the 31st pattern 14*a* and the first end of the 32nd pattern 14*b* that are grounded allow more current to flow. This strengthens the magnetic field. The strengthened magnetic field around the 31st pattern 14*a* strengthens the magnetic field-coupling between the 31st pattern 14*a* and the first dielectric block 100 (FIG. 3). The strengthened magnetic field around the 32nd pattern 14*b* strengthens the magnetic field-coupling between the 32nd pattern 14*b* and the second dielectric block 200.

When the dielectric filter unit 1 shown in FIGS. 1 to 4 receives high-frequency signals, the high-frequency signals are input through the 22nd pattern 13*b*. The input signals then propagate through the via 16*a* to the 31st pattern 14*a* that serves as the input line. The signals excite transverse magnetic (TM) mode signals inside the first dielectric block 100. The excited signals inside the first dielectric block 100 excite TM mode signals inside the third dielectric block 300. The excited signals inside the third dielectric block 300 excite TM mode signals inside the second dielectric block 200. The signals excited inside the second dielectric block 200 propagate through the magnetic field-coupling between the second dielectric block 200 and the 32nd pattern 14*b* to the 32nd pattern 14*b* that serves as the output line. The signals reaching the 32nd pattern 14*b* are output from the 23rd pattern 13*c* through the via 16*a*. The TM mode is a resonance mode of an electromagnetic field excitable inside the dielectric blocks.

Signals propagating through the 31st pattern 14*a* in X-direction generate a magnetic field loop around the 31st pattern 14*a* in the YZ plane orthogonal to X-axis as shown in FIGS. 3 and 4. The magnetic field loop may enter the first dielectric block 100 through the openings 12*d* and 104*b*. The magnetic field loop induces an electric field vector in X-direction inside the first dielectric block 100.

Figure 5:
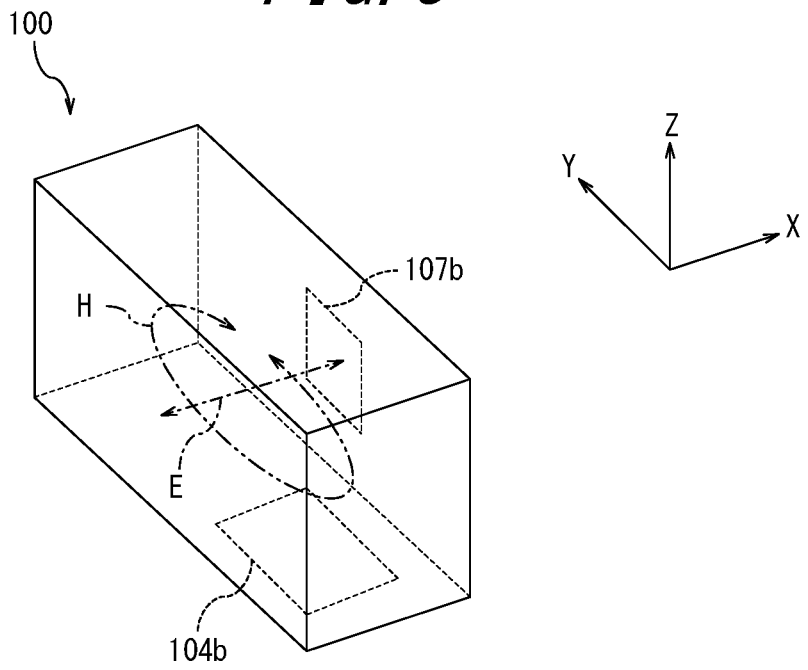
FIG. 5 is a schematic perspective view of an electric field and a magnetic field inside a dielectric block.

The electric field vector induced inside the first dielectric block 100 generates a magnetic field loop inside the first dielectric block 100. As shown in FIG. 5, for example, the electric field vector with letter E is induced linearly in X-direction. The magnetic field loop with letter H is generated elliptically around the electric field vector as its axis in the YZ plane orthogonal to the electric field vector.

Figure 6:
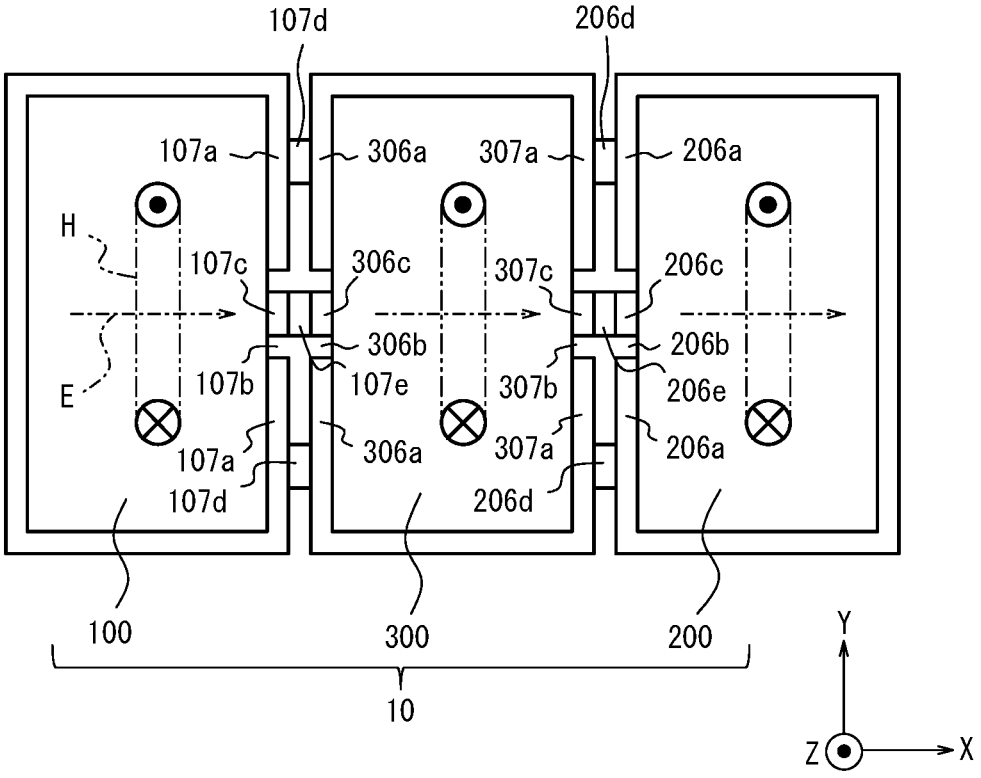
FIG. 6 is a schematic cross-sectional view of an electric field and a magnetic field inside dielectric blocks.

The electric field vector induced in the first dielectric block 100 and the magnetic field loop generated by the electric field vector generate a TM mode resonance with a predetermined resonance frequency inside the first dielectric block 100. FIGS. 5 and 6 show the electric field vector and the magnetic field loop generating a TM mode resonance with the electric field vector in X-direction. The TM mode with the electric field vector in X-direction will also be referred to as a TM-X mode. The TM mode resonance may not be generated with the electric field vector in X-direction, and may be generated with the electric field vector in Y-direction or Z-direction. The TM mode with the electric field vector in Y-direction will also be referred to as a TM-Y mode. The TM mode with the electric field vector in Z-direction will also be referred to as a TM-Z mode. The 31st pattern 14*a* extends in X-direction near the openings 12*d* and 104*b*. The 31st pattern 14*a* near the openings 12*d* and 104*b* generates a magnetic field loop in the YZ plane orthogonal to the X-axis. The magnetic field loop generated in the YZ plane easily excites a TM-X mode resonance inside the first dielectric block 100.

Each dielectric block is electromagnetically coupled to other adjacent dielectric blocks through the openings 107*b* and 306*b*, and the openings 307*b* and 206*b*. The dielectric blocks arranged in X-direction allow signals with a resonance frequency of a TM-X mode resonance to propagate in X-direction inside the dielectric filter 10. Signals with a resonance frequency of a TM-X mode resonance propagate strongly through the dielectric blocks arranged in X-direction along the electric field vector. In other words, the dielectric blocks are electric field-coupled.

Signals in the TM-X mode propagate more easily than signals in the TM-Y and TM-Z modes. The dielectric blocks 100, 200, and 300 having openings 107*b*, 306*b*, 307*b*, and 206*b* in a central portion of the YZ plane having a large TM-X mode electric field allow easier propagation of signals along the electric field vector.

In the dielectric filter unit 1, the dielectric blocks are electric field-coupled. In the dielectric filter unit 1, the dielectric blocks that are electric field-coupled allow an attenuation pole (antiresonance point) to appear in a lower frequency region than the resonance frequency. The dielectric filter unit 1 can use the attenuation pole to obtain frequency characteristics having an attenuation band at lower frequencies than those of the passband. A passband is a frequency band with less attenuation of signals passing through the dielectric filter unit 1. An attenuation band is a frequency band with greater attenuation of signals passing through the dielectric filter unit 1.

The dielectric filter unit 1 has a higher resonance frequency in the TM-Y mode and the TM-Z mode than in the TM-X mode. The dielectric filter unit 1 defines its passband corresponding to the frequencies obtained in the TM-X mode, in which the resonance is at the lowest frequency. The dielectric filter unit 1 has higher resonance frequencies in the TM-Y mode and the TM-Z mode than in the TM-X mode, and has its attenuation band, which has a lower frequency than the passband, less susceptible in the TM-Y and TM-Z modes.

The TM mode resonance frequency is determined depending on the size of the magnetic field-loop. As the magnetic field loop is larger, the resonance frequency is lower. As the dielectric block has a larger cross-sectional area corresponding to a plane in which the magnetic field loop is generated, the magnetic field loop is larger. For example, when a TM-X mode resonance occurs inside the first dielectric block 100, the TM-X mode resonance generates a magnetic field loop in a plane parallel to the third face 106 and the fourth face 107. The magnetic field loop due to the TM-X mode resonance is larger as the areas of the third face 106 and the fourth face 107 are larger. As the areas of the third face 106 and the fourth face 107 are larger, the TM-X mode resonance frequency can decrease. The TM-Y mode resonance frequency can decrease as the areas of the fifth face 108 and the sixth face 109 are larger. The TM-Z mode resonance frequency can decrease as the areas of the second face 105 and the first face 104 are larger. The relationship between the resonance frequency and the areas of the faces is common to all the dielectric blocks.

For example, the first dielectric block 100 may have the third face 106 and the fourth face 107 with larger areas than the second face 105 and the first face 104 and than the fifth face 108 and the sixth face 109. When the first dielectric block 100 has the smallest length in X-direction, the third face 106 and 107 have the largest areas. In this structure, the TM-X mode magnetic field loop is larger than the TM-Y mode magnetic field loop and the TM-Z mode magnetic field loop. The resultant TM-X mode resonance frequency is lower than the resonance frequencies in the TM-Y mode and TM-Z mode. These mode resonance frequencies are determined depending on the relative areas of the faces of the dielectric blocks.

When the first dielectric block 100 or the second dielectric block 200 has a TM-X mode resonance, the magnetic field loop can partially leak through the opening 104*b* or 204*b*. This increases the magnetic field loop, and can decrease the resonance frequency. The third dielectric block 300 can have a resonance frequency nearer the resonance frequencies in the first dielectric block 100 and the second dielectric block 200 by adjusting the opening 304*b*, which serves as a dummy opening. The third dielectric block 300 has the opening 304*b* in its bottom surface 304 at one position along the Y-direction. In this structure, the transmission line inside the substrate 11 located at one position along the Y-direction can be less susceptible to the resultant magnetic field loop leaking through the opening 304*b*.

The dielectric blocks can have spaces therebetween. The dielectric constant can either decrease or vary in such spaces. This can either lower or vary the intensity of signals propagating through the dielectric blocks. The dielectric filter 10 has the connecting conductive layers 107*c* and 306*c*, and the connecting conductive layers 307*c* and 206*c* that electrically communicate with each other. This structure can reduce the influence of such spaces. The dielectric filter 10 having the connecting conductive layers 107*c*, 306*c*, 307*c*, and 206*c* can have stable electrical field-coupling between the dielectric blocks despite such spaces.

The dielectric blocks can be sized in accordance with the specifications for the TM-X mode resonance frequency. For example, the dielectric blocks can have lengths in Y-direction and Z-direction to meet the specifications for the TM-X mode resonance frequency. The dielectric blocks have a length in Z-direction corresponding to the height of the entire dielectric filter unit 1 rising from the substrate 11. The dielectric blocks may have a length in Z-direction to meet the specifications for the outer dimensions of the dielectric filter unit 1.

The dielectric blocks have lengths in X-direction in accordance with the specifications for the loss of signals propagating through the blocks. As the dielectric blocks have smaller lengths in X-direction, each dielectric block can have more loss. Each dielectric block with more loss can form a resonator with lower quality factor (Q factor).

The openings 107*b*, 306*b*, 307*b*, and 206*b* can be located to maximize the electric fields generated by the TM-X mode resonance on the fourth faces 107, 306, 307, and 206 of the dielectric blocks. The openings 107*b*, 306*b*, 307*b*, and 206*b* each can be sized in accordance with the specifications for the coupling strength between the dielectric blocks. The connecting conductive layers 107*c*, 306*c*, 307*c*, and 206*c* each can be sized large enough without electrically communicating with the conductive layers 107*a*, 306*a*, 307*a*, and 206*a*.

Figure 7:
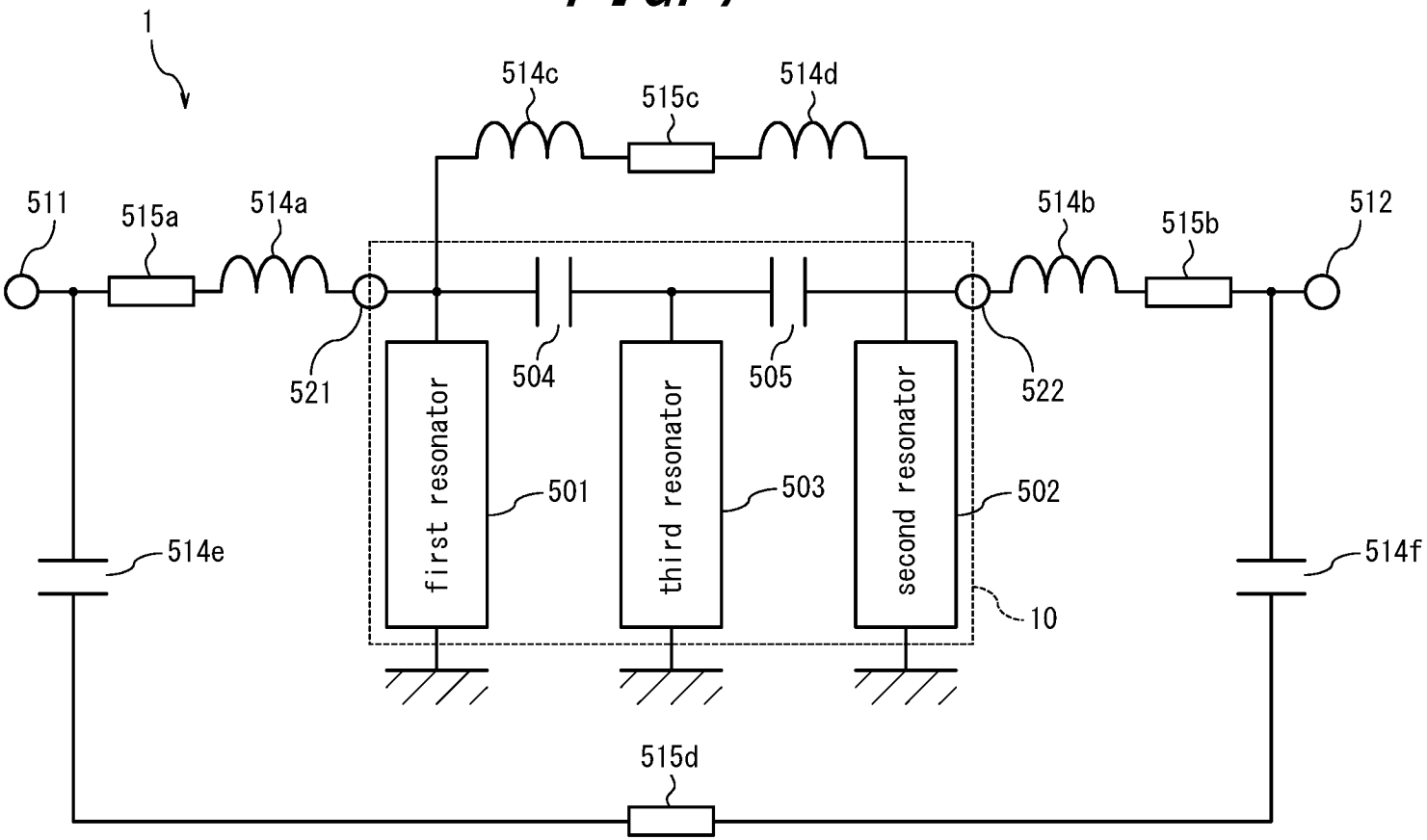
FIG. 7 is a schematic circuit diagram of the dielectric filter unit shown in FIGS. 1 to 4.

As shown in FIG. 7, the dielectric filter unit 1 is a circuit schematically including the dielectric filter 10. The dielectric filter 10 includes a first resonator 501, a second resonator 502, a third resonator 503, capacitors 504 and 505, an input unit 521, and an output unit 522. The first resonator 501, the second resonator 502, and the third resonator 503 respectively correspond to the first dielectric block 100, the second dielectric block 200, and the third dielectric block 300. The first resonator 501, the second resonator 502, and the third resonator 503 will also be simply referred to as the "resonators." The input unit 521 corresponds to the opening 104*b* of the first dielectric block 100. The output unit 522 corresponds to the opening 204*b* of the second dielectric block 200.

The first resonator 501 and the third resonator 503 have the capacitor 504 connected between them, indicating that the first resonator 501 and the third resonator 503 are capacitively coupled dominantly rather than inductively coupled. The third resonator 503 and the second resonator 502 have the capacitor 505 connected between them, indicating that the third resonator 503 and the second resonator 502 are capacitively coupled dominantly rather than inductively coupled.

The first resonator 501, the second resonator 502, and the third resonator 503 are connected in parallel. The resonators each have a second terminal electromagnetically coupled through the capacitor 504 or 505.

In the schematic circuit diagram of FIG. 7, the dielectric filter unit 1 includes an input terminal 511, an output terminal 512, inductors 514*a*, 514*b*, 514*c*, and 514*d*, capacitors 514*e* and 514*f*, and transmission lines 515*a*, 515*b*, 515*c*, and 515*d*.

The input terminal 511 corresponds to the 22nd pattern 13*b*. The output terminal 512 corresponds to the 23rd pattern 13*c*. In the dielectric filter unit 1, signals are input through the 22nd pattern 13*b*, and output through the 23rd pattern 13*c*.

The inductor 514*a* is connected between the transmission line 515*a* and the input unit 521. The inductor 514*a* corresponds to the magnetic field-coupling between the 31st pattern 14*a*, which is the input line, and the first dielectric block 100. The inductor 514*b* is connected between the transmission line 515*b* and the output unit 522. The inductor 514*b* corresponds to the magnetic field-coupling between the 32nd pattern 14*b*, which is the output line, and the second dielectric block 200.

The inductor 514*c* is connected between the first resonator 501 and the transmission line 515*c*. The inductor 514*c* corresponds to the magnetic field-coupling between the 33rd pattern 14*c*, which is the first skip-connecting line, and the first dielectric block 100. An inductor referred to as 514*d* is connected between the transmission line 515*c* and the second resonator 502. The inductor 514*d* corresponds to the magnetic field-coupling between the 33rd pattern 14*c* and the second dielectric block 200.

The capacitor 514*e* shows that the 34th pattern 14*d*, which is the second skip-connecting line, and the 22nd pattern 13*b* are capacitively coupled. The capacitor 514*f* shows that the 34th pattern 14*d*, which is the second skip-connecting line, and the 23rd pattern 13*c* are capacitively coupled.

The capacitors 514*e* and 514*f*, and the transmission line 515*d* are connected in parallel in the circuit including the dielectric filter 10 connected between the input terminal 511 and the output terminal 512.

The input line can adjust the strength of its coupling with the first resonator 501 by varying the length and the width of the line. The output line can adjust the strength of its coupling with the second resonator 502 by varying the length and the width of the line. The first skip-connecting line can adjust the attenuation pole frequency by varying the length and the width of the line. The second skip-connecting line can adjust the attenuation pole frequency by varying the length and the width of the line.

Figure 8:
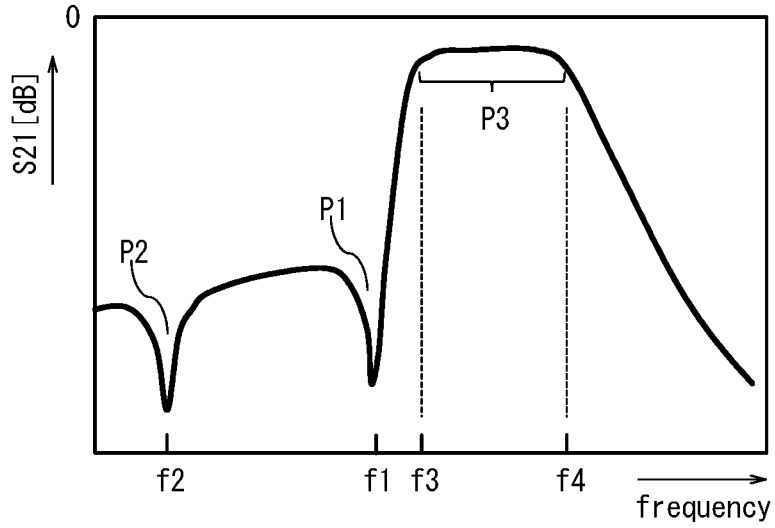
FIG. 8 is a graph showing example frequency characteristics of a dielectric filter unit.

The dielectric filter unit 1 has the frequency characteristics shown in, for example, FIG. 8. In FIG. 8, the horizontal axis shows the frequency, and the vertical axis shows the passage attenuation S21 in dB. In the frequency characteristics illustrated in FIGS. 8, P1 and P2 each indicate an attenuation pole at which the passage attenuation S21 is extremely small. P3 indicates a passband exhibiting a frequency band where the passage attenuation S21 is almost zero decibel (dB). P1 and P2 respectively correspond to frequencies f1 and f2. The passband P3 corresponds to the frequency range of f3 to f4. The dielectric filter unit 1 with the frequency characteristics shown in FIG. 8 has less attenuation of the frequency component in the range of f3 to f4, and greater attenuation of the frequency component in the range of f2 to f1.

In the schematic circuit diagram of FIG. 7, the attenuation pole P1 is attributable to the parallel circuit including the capacitors 504 and 505, the inductors 514*c* and 514*x*, and the transmission line 515*c* between the input unit 521 and the output unit 522. The frequency f1 corresponds to the frequency at which the impedance of the parallel circuit is infinite.

The attenuation pole P2 is attributable to the parallel circuit of the first path and the second path between the input terminal 511 and the output terminal 512. The frequency f2 corresponds to the frequency at which the impedance of the parallel circuit between the first path and the second path is infinite. In the schematic circuit diagram of FIG. 7, the first path is a circuit including the transmission lines 515*a* and 515*b*, the inductors 514*a* and 514*b*, and the capacitors 504 and 505. In the schematic circuit diagram of FIG. 7, the second path is a circuit including the capacitors 514*e* and 514*f*, and the transmission line 515*d*.

The passband P3 is determined depending on the resonance frequencies and the coupling strength of the dielectric blocks 100, 200, and 300.

The dielectric filter unit 1 has the attenuation pole P1 resulting from the first skip-connecting line. The dielectric filter unit 1 having the attenuation pole P1 has a sharp decrease in the passage attenuation S21 in the frequency range lower than the frequency f3. The dielectric filter unit 1 can have higher performance of attenuating frequency components in the range lower than the frequency f3.

The dielectric filter unit 1 has the attenuation pole P2 resulting from the second skip-connecting line. The dielectric filter unit 1 having the attenuation pole P2 has a decrease in the passage attenuation S21 in the frequency range lower than the frequency f1. The dielectric filter unit 1 can have higher performance of attenuating the frequency component in the range lower than the frequency f1.

The dielectric filter unit 1 and the dielectric filter 10 have the connecting conductive layers 107*c* and 306*c* that electrically communicate with each other, and the connecting conductive layers 307*c* and 206*c* that electrically communicate with each other. Despite the spaces between the dielectric blocks, the dielectric filter unit 1 and the dielectric filter 10 having the connecting conductive layers have stable electric field-coupling between the dielectric blocks. The dielectric filter unit 1 and the dielectric filter 10 with the connecting conductive layers can propagate signals with a smaller decrease and less variations in the intensity through the dielectric blocks. The dielectric filter unit 1 and the dielectric filter 10 can thus have its passband width less likely to be narrowed or varied while propagating signals with a smaller decrease in the intensity.

The dielectric filter 10 may have the openings 107*b*, 306*b*, 307*b*, and 206*b* sized in accordance with the specifications of the passband width of the dielectric filter 10.

Figure 9:
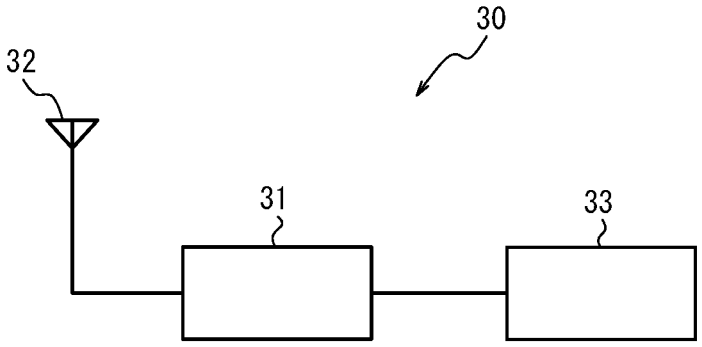
FIG. 9 is a schematic diagram of a communication device according to one embodiment.

As shown in FIG. 9, a communication device 30 according to an embodiment includes a radio frequency (RF) unit 31 including a transmitter and receiver circuit, an antenna 32, and a baseband unit 33 connected to the RF unit 31 and the antenna 32.

The RF unit 31 includes the dielectric filter unit 1. The dielectric filter unit 1 greatly attenuates the intensity of signals in the frequency band other than the frequency band used for transmission and reception. The baseband unit 33 may be a known baseband unit, and the antenna 32 may be a known antenna.

The communication device 30 according to the present embodiment including the dielectric filter unit 1 according to the present embodiment can have its passband width less likely to be narrowed or varied.

Figure 10:
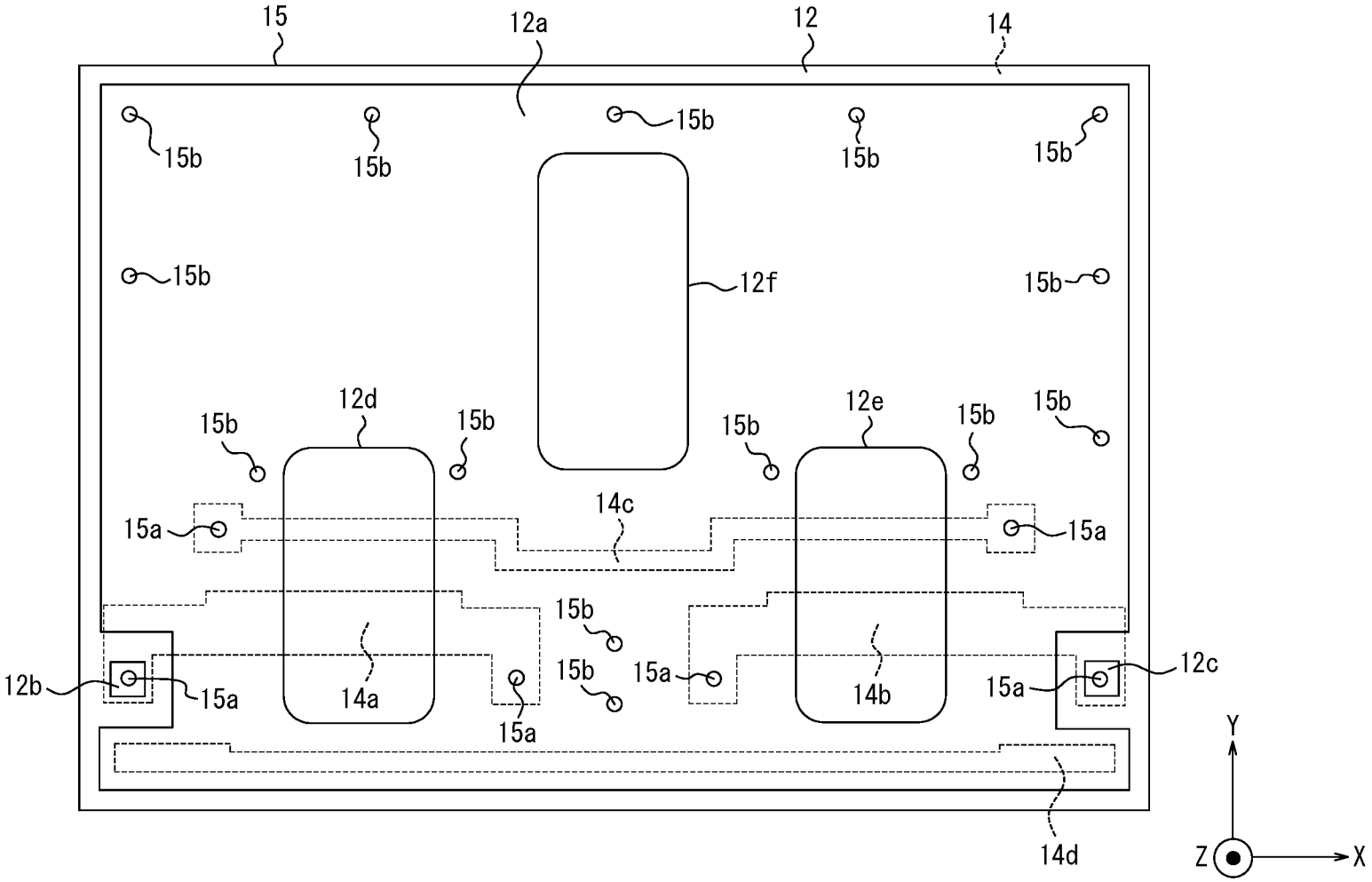
FIG. 10 is a plan view of the substrate shown in FIG. 3.
Figure 11:
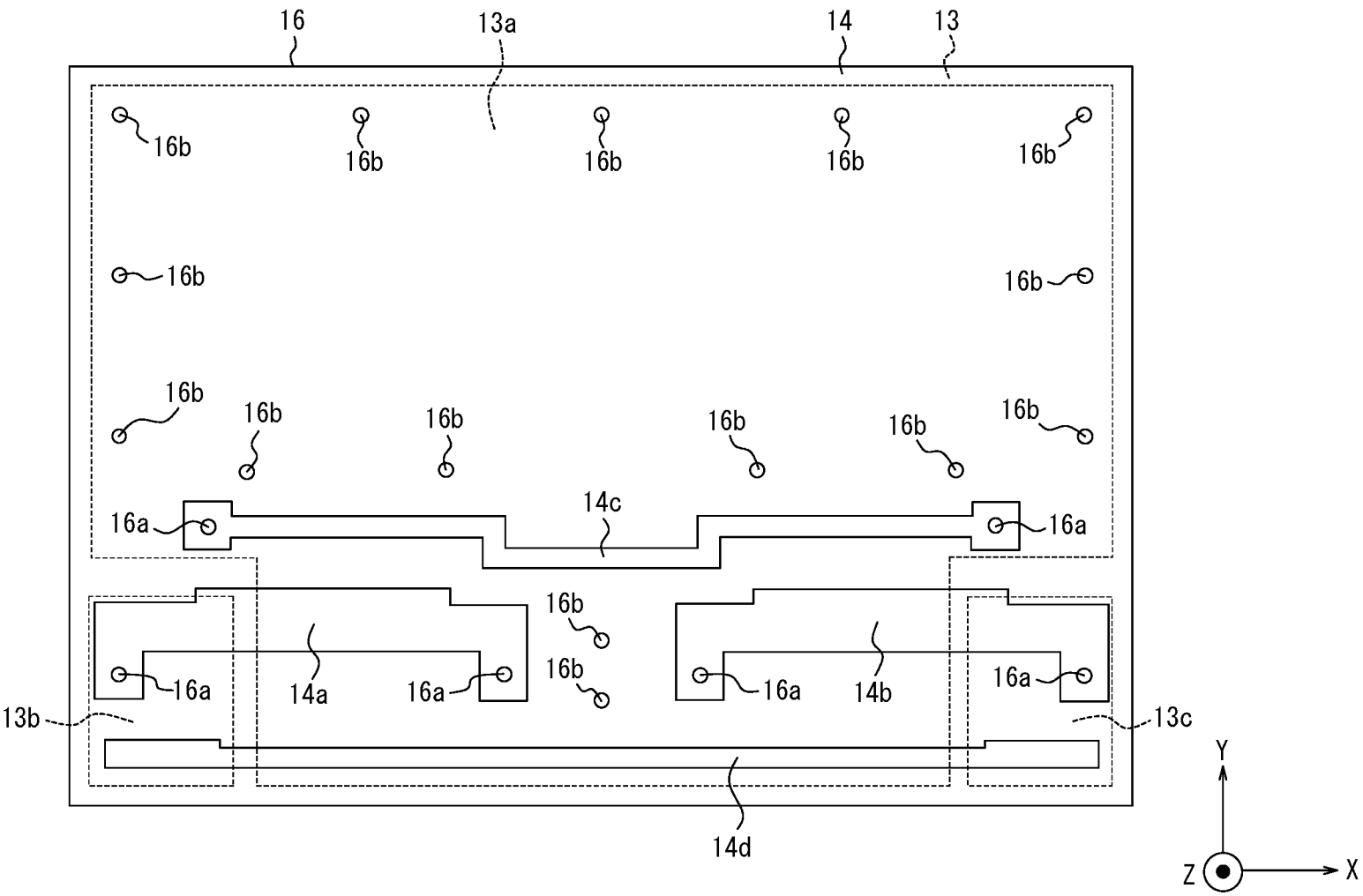
FIG. 11 is a plan view of the substrate shown in FIG. 4.

Referring to FIGS. 10 and 11, the circuit patterns of the substrate 11 will now be described in more detail. FIG. 10 shows the first substrate surface 12, the first substrate 15, and the intermediate surface 14. In FIG. 10, solid lines indicate the circuit patterns on the first substrate surface 12. In FIG. 10, broken lines indicate the circuit patterns on the intermediate surface 14. FIG. 11 shows the intermediate surface 14, the second substrate 16, and the second substrate surface 13. In FIG. 11, solid lines indicate the circuit patterns on the intermediate surface 14. In FIG. 11, broken lines indicate the circuit patterns on the second substrate surface 13.

In the opening 12*d* (FIG. 10), the 33rd pattern 14*c* as the first skip-connecting line is located nearer the center in Y-direction of the first substrate 15 (FIG. 10) than the 31st pattern 14*a* as the input line. In the opening 12*e* (FIG. 10), the 33rd pattern 14*c* is located nearer the center in Y-direction of the first substrate 15 than the 32nd pattern 14*b* as the output line.

The 33rd pattern 14*c* as the first skip-connecting line may have a smaller pattern width than the 31st pattern 14*a* and the 32nd pattern 14*b*. The first skip-connecting line can be located to have a greater distance from the opening 12*f* (FIG. 10) of the third dielectric block 300. The first skip-connecting line is thus less susceptible to the magnetic field loop leaking through the opening 304*b* in the third dielectric block 300.

The 33rd pattern 14*c* as the first skip-connecting line may have a greater pattern width in its portions facing the openings 12*d* and 12*e* than its other portions. The 33rd pattern 14*c* having a greater width in its the portions facing the openings 12*d* and 12*e* allows the first skip-connecting line and the dielectric blocks to have stronger electromagnetic coupling.

Figure 12:
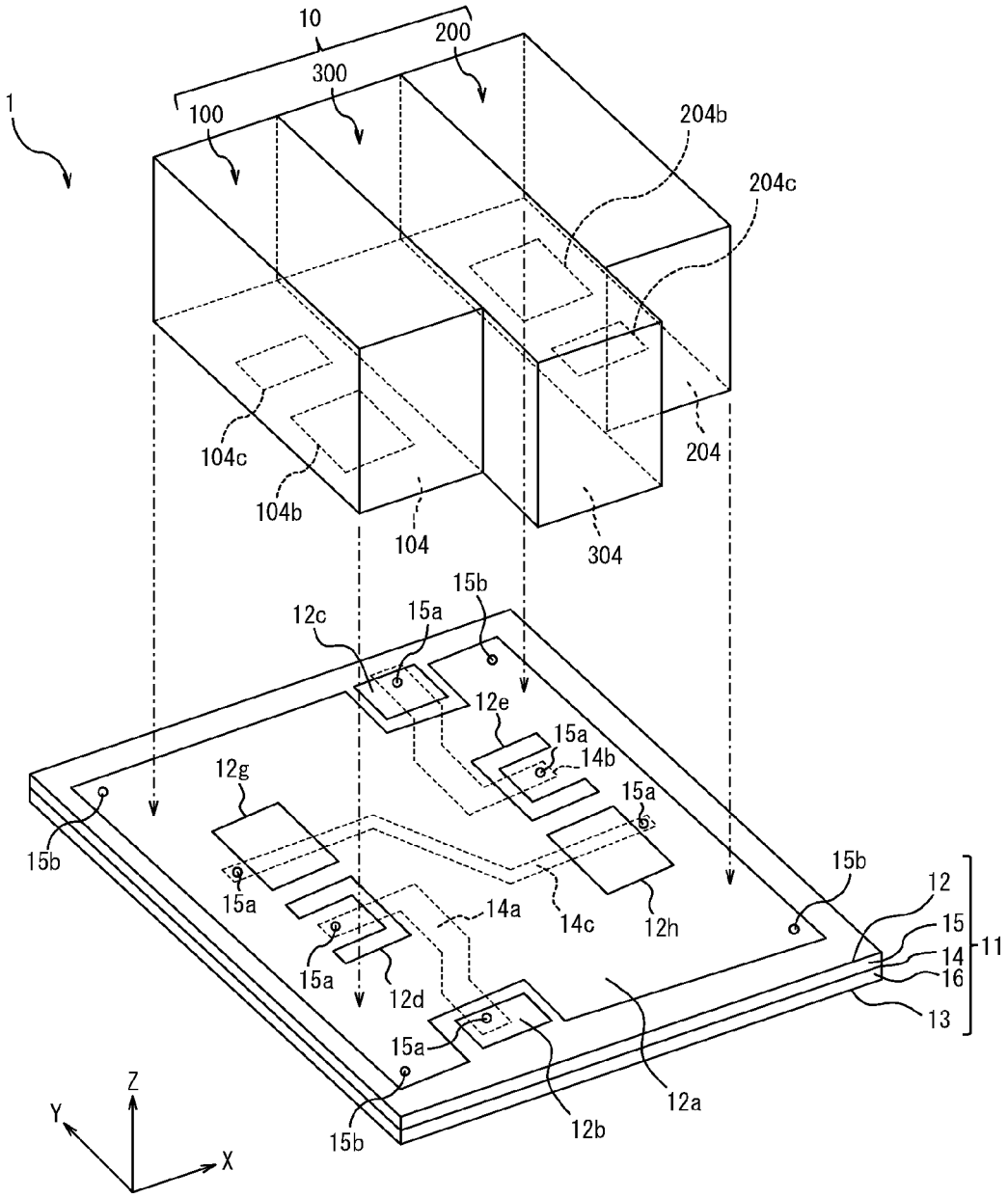
FIG. 12 is an exploded perspective view of a dielectric filter unit according to another embodiment.
Figure 13:
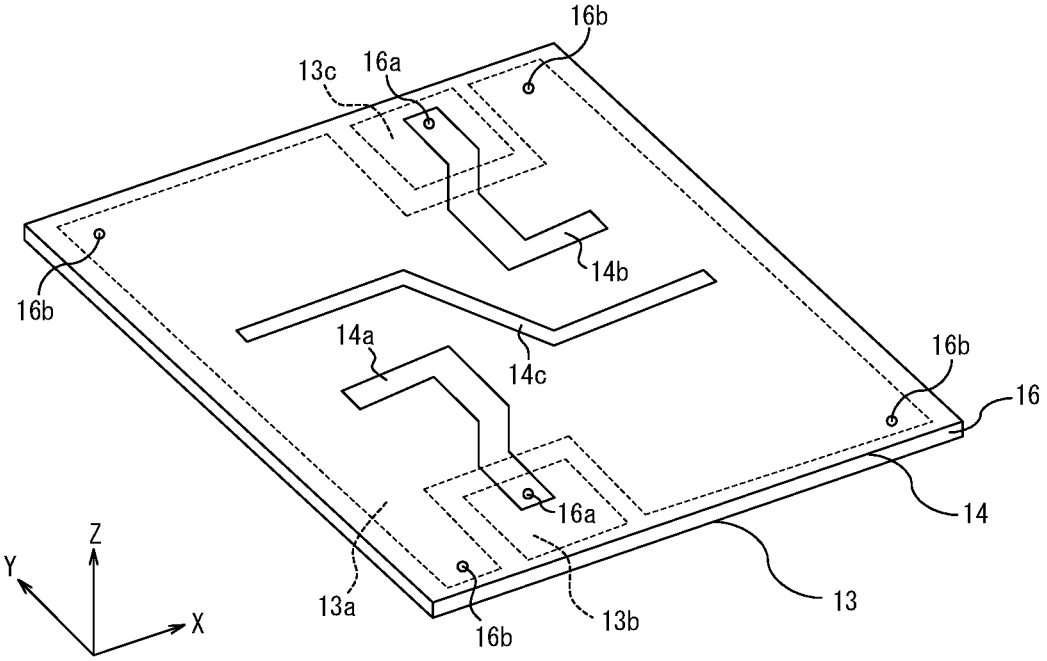
FIG. 13 is a perspective view of patterns on an intermediate surface and a second substrate surface of the substrate shown in FIG. 12.

Referring to FIGS. 12 and 13, a dielectric filter unit 1 (FIG. 12) according to another embodiment will be described. The components of the dielectric filter unit 1 in this embodiment common to those of the dielectric filter unit 1 shown in FIGS. 1 to 4 will not be described.

As shown in FIG. 12, the first dielectric block 100 has openings 104*b* and 104*c* in the first face 104. The opening 104*c* will also be referred to as a "third opening." The second dielectric block 200 has the opening 204*c* in addition to an opening 204*b* in a first face 204. The opening 204*c* will also be referred to as a "fourth opening". The third dielectric block 300 has no opening in a first face 304. The third dielectric block 300 has a length in Y-direction longer than a length in Y-direction of the first dielectric block 100 and the second dielectric block 200. The length in Y-direction will also be referred to as a length in a direction intersecting with X-direction, in which the dielectric blocks are arranged.

The third dielectric block 300 with no opening in the first face 304 causes no external leakage of the TM-X mode magnetic field loop generated inside the third dielectric block 300. The third dielectric block 300 with no opening in the first face 304 has a higher resonance frequency than a block having an opening in the first surface 304. When one of the other dielectric blocks has a longer length either in Y-direction or Z-direction than the corresponding length in the third dielectric block, the third dielectric block has a lower resonance frequency than when all the dielectric blocks have the same lengths in Y- and Z-directions. The third dielectric block 300 has a resonance frequency adjustable by an opening or no opening in the first face 304, or by varying the length in Y-direction of the third dielectric block 300. The third dielectric block 300 can have a resonance frequency near the resonance frequencies of the first dielectric block 100 and the second dielectric block 200 by varying the length in Y-direction of the third dielectric block 300. The resonance frequency of the third dielectric block 300 may be adjustable by varying the length not only in Y-direction of the third dielectric block 300 but also in Z-direction. The resonance frequency of the first dielectric block 100 may be adjustable by varying the length in Y- or Z-direction of the first dielectric block 100. The resonance frequency of the second dielectric block 200 may be adjustable by varying the length in Y- or Z-direction of the second dielectric block 200.

As shown in FIG. 12, the 11th pattern 12*a* on the first substrate surface 12 has openings 12*g* and 12*h* in addition to the openings 12*d* and 12*e*. The openings 12*d* and 12*e* face the corresponding openings 104*b* and 204*b* in the dielectric filter 10. The openings 12*g* and 12*h* face the corresponding openings 104*c* and 204*c* of the dielectric filter 10. As the dielectric filter 10 have more openings, the 11th pattern 12*a* has more openings.

The signals traveling through the 31st pattern 14*a* generates a magnetic field loop, which may enter the first dielectric block 100 through the openings 12*d* and 104*b*. In other words, the 31st pattern 14*a* and the first dielectric block 100 can be electromagnetically coupled through the opening 12*d*. The 32nd pattern 14*b* and the second dielectric block 200 can be electromagnetically coupled through the opening 12*e*. The first end of the 33rd pattern 14*c* and the first dielectric block 100 can be electromagnetically coupled through the opening 12*g*. The second end of the 33rd pattern 14*c* and the second dielectric block 200 can be electromagnetically coupled through the opening 12*h*. The openings 12*d* and 12*g* may be formed as one opening, like the opening 12*d* in FIG. 3. The openings 12*e* and 12*h* may be formed as one opening, like the opening 12*e* in FIG. 3.

The embodiments according to the present disclosure are not limited to the above embodiments, but may be changed and modified variously without departing from the spirit and scope of the present disclosure.

The adjacent dielectric blocks have connecting conductive layers on each of the two facing faces. The adjacent dielectric blocks may have no connecting conductive layer on either or both the two facing faces. For example, the first dielectric block 100 and the third dielectric block 300, which are adjacent to each other, may not have either or both the connecting conductive layer 107*c* and the connecting conductive layer 306*c*. For example, when the block eliminates only the connecting conductive layer 107*c*, the facing connecting conductive layer 306*c* or a connection member 306*e* on the connecting conductive layer 306 may be adjacent to the opening 107*b* of the first dielectric block 100.

The dielectric blocks each have a conductive layer on each face. The adjacent dielectric blocks may not have a conductive layer on one of their two facing faces. For example, the first dielectric block 100 and the third dielectric block 300 adjacent to each other may eliminate either the conductive layer 107*a* or the conductive layer 306*a*. When the conductive layer 107*a* is eliminated, the conductive layer 306*a* is arranged nearer the fourth face 107 of the first dielectric block 100 to have a smaller space or no space between them.

The dielectric blocks may not be three blocks but may be four or more blocks. Any other number of dielectric blocks can have their frequency characteristics adjustable by varying the dimensions of the dielectric blocks in X-, Y-, and Z-directions as appropriate to achieve an intended resonance frequency.

Each dielectric block has an opening in the conductive layer adjacent to the other dielectric blocks. Each dielectric block may have an opening in a face that is not adjacent to other dielectric blocks. For example, the resonance frequency of each dielectric block can be adjustable by the opening in a face that is not adjacent to other dielectric blocks. The dielectric blocks have a lower resonance frequency as the number or the areas of the openings of the conductive layer on each face are larger.

In the TM-X mode resonance generated inside each dielectric block, the resonance frequency is determined by the size of the magnetic field loop in the plane YZ orthogonal to X-axis. As the magnetic field loop is larger, the resonance frequency is lower. When the opening of the conductive layer on each face partially leaks the corresponding magnetic field-loop, the magnetic field loop can be larger. A larger magnetic field loop can lower the resonance frequency of the corresponding dielectric block.

For example, the dielectric filter unit 1 can incorporate the dielectric blocks having a resonance frequency that is preset higher than an intended frequency. In this case, the assembled dielectric filter unit 1 can have an opening with an appropriate size to adjust the resonance frequency to the intended frequency.

In the present disclosure, the first, the second, or others are identifiers for distinguishing the components. The identifiers of the components distinguished with the first, the second, and others in the present disclosure are interchangeable. For example, the first opening can be interchangeable with the second opening. The identifiers are to be interchanged together. The components for which the identifiers are interchanged are also to be distinguished from one another. The identifiers may be eliminated. The components without such identifiers can be distinguished with symbols. The identifiers such as the first and the second in the present disclosure alone should not be used to determine the orders of the components or to determine the existence of smaller number identifiers.

REFERENCE SIGNS LIST

1 dielectric filter unit
10 dielectric filter
11 substrate
12 first substrate surface
12*a*, 12*b*, 12*c* 11th pattern, 12th pattern, 13th pattern
12*d*, 12*e*, 12*f*, 12*g* opening
13 second substrate surface
13*a*, 13*b*, 13*c* 21st pattern, 22nd pattern, 23rd pattern
14 intermediate surface
14*a*, 14*b*, 14*c*, 14*d* 31st pattern, 32nd pattern, 33rd pattern, 34th pattern
15 first substrate
15*a*, 15*b* via
16 second substrate
16*a*, 16*b* via
100, 200, and 300 first dielectric block, second dielectric block, third dielectric block
104, 204, 304 first face
105, 205, 305 second face
106, 206, 306 third face
107, 207, 307 fourth face
108, 208, 308 fifth face
109, 209, 309 sixth face
104*a* to 109*a*, 204*a* to 209*a*, 304*a* to 309*a* conductive layer
104*b*, 204*b*, 304*b* first conductive layer, second conductive layer, third conductive layer
104*c*, 204*c* fourth opening, fifth opening
107*b*, 206*b*, 306*b*, 307*b* opening
107*c*, 206*c*, 306*c*, 307*c* connecting conductive layer
10 7*d*, 107*e*, 206*d*, 206*e* connection member
30 communication device
31 RF unit
32 antenna
33 baseband unit
501, 502, 503 first resonator, second resonator, third resonator
504, 505 capacitor
511 input terminal

512 output terminal
514*a*, 514*b*, 514*c*, 514*d* inductor
514*e*, 514*f* capacitor
515*a*, 515*b*, 515*c*, 515*d* transmission line
521 input unit
522 output unit
P1, P2 attenuation pole
P3 passband
X, Y, Z directions

The invention claimed is:

1. A dielectric filter unit, comprising:

three or more dielectric blocks including a first dielectric block and a second dielectric block, the three or more dielectric blocks being arranged adjacent to each other in a predetermined direction; and a transmission line, wherein the three or more dielectric blocks include a third dielectric block between the first dielectric block and the second dielectric block, the third dielectric block being different from the first dielectric block and the second dielectric block, each of the three or more dielectric blocks is electromagnetically coupled to one or two adjacent dielectric blocks included in the three or more dielectric blocks, and the first dielectric block and the second dielectric block are electromagnetically coupled to each other through the transmission line, and the transmission line is electromagnetically isolated from the third dielectric block or is electromagnetically coupled to the third dielectric block more weakly than is coupled to the first dielectric block and the second dielectric block.

2. The dielectric filter unit according to claim 1, wherein the first dielectric block includes a first conductive layer having a first opening through which an input signal passes, the second dielectric block includes a second conductive layer having a second opening through which an output signal passes, and each of the three or more dielectric blocks receives a signal based on the input signal and resonates the signal with a predetermined resonance characteristic.

3. The dielectric filter unit according to claim 2, wherein the transmission line is electromagnetically coupled to the first dielectric block through the first opening, and is electromagnetically coupled to the second dielectric block through the second opening.

4. The dielectric filter unit according to claim 2, wherein the first conductive layer has a third opening different from the first opening, the second conductive layer has a fourth opening different from the second opening, and the transmission line is electromagnetically coupled to the first dielectric block through the third opening, and is electromagnetically coupled to the second dielectric block through the fourth opening.

5. The dielectric filter unit according to claim 1, wherein the third dielectric block includes a third conductive layer having at least one fifth opening in a face thereof other than faces adjacent to other dielectric blocks included in the three or more dielectric blocks.

6. The dielectric filter unit according to claim 1, wherein the third dielectric block has a length different from a length of each of the first dielectric block and the second dielectric block along a length direction.

7. The dielectric filter unit according to claim 1, wherein each of the three or more dielectric blocks includes a respective conductive layer, each of the three or more dielectric blocks is electromagnetically coupled to other dielectric blocks included in the three or more dielectric blocks through a respective opening of a corresponding conductive layer, and at least one of the three or more dielectric blocks includes a respective connecting conductive layer inside the corresponding opening.

8. The dielectric filter unit according to claim 1, wherein each of the three or more dielectric blocks has a smaller length in the predetermined direction than in directions other than the predetermined direction.

9. A communication device comprising:

a dielectric filter unit including three or more dielectric blocks including a first dielectric block and a second dielectric block, the three or more dielectric blocks being arranged adjacent to each other in a predetermined direction, and a transmission line, wherein the three or more dielectric blocks include a third dielectric block between the first dielectric block and the second dielectric block, the third dielectric block being different from the first dielectric block and the second dielectric block, each of the three or more dielectric blocks is electromagnetically coupled to one or two adjacent dielectric blocks included in the three or more dielectric blocks, and the first dielectric block and the second dielectric block are electromagnetically coupled to each other through the transmission line, and the transmission line is electromagnetically isolated from the third dielectric block or is electromagnetically coupled to the third dielectric block more weakly than is coupled to the first dielectric block and the second dielectric block.

10. The communication device according to claim 9, wherein the first dielectric block includes a first conductive layer having a first opening through which an input signal passes, the second dielectric block includes a second conductive layer having a second opening through which an output signal passes, and each of the three or more dielectric blocks receives a signal based on the input signal and resonates the signal with a predetermined resonance characteristic.

11. The communication device according to claim 10, wherein the transmission line is electromagnetically coupled to the first dielectric block through the first opening, and is electromagnetically coupled to the second dielectric block through the second opening.

12. The communication device according to claim 10, wherein the first conductive layer has a third opening different from the first opening, the second conductive layer has a fourth opening different from the second opening, and the transmission line is electromagnetically coupled to the first dielectric block through the third opening, and is electromagnetically coupled to the second dielectric block through the fourth opening.

13. The communication device according to claim 9, wherein the third dielectric block includes a third conductive layer having at least one fifth opening in a face thereof other than faces adjacent to other dielectric blocks included in the three or more dielectric blocks.

14. The communication device according to claim 9, wherein the third dielectric block has a length different from a length of each of the first dielectric block and the second dielectric block along a length direction.

15. The communication device according to claim 9, wherein each of the three or more dielectric blocks includes a respective conductive layer, each of the three or more dielectric blocks is electromagnetically coupled to other dielectric blocks included in the three or more dielectric blocks through a respective opening of a corresponding conductive layer, and at least one of the three or more dielectric blocks includes a respective connecting conductive layer inside the corresponding opening.

16. The communication device according to claim 9, wherein each of the three or more dielectric blocks has a smaller length in the predetermined direction than in directions other than the predetermined direction.

17. A dielectric filter unit, comprising:

three or more dielectric blocks including a first dielectric block and a second dielectric block, the three or more dielectric blocks being arranged adjacent to each other in a predetermined direction; and a transmission line, wherein the three or more dielectric blocks include at least one dielectric block between the first dielectric block and the second dielectric block, the three or more dielectric blocks each having closed end faces which are completely covered by a conductive layer, each of the three or more dielectric blocks is electromagnetically coupled to one or two adjacent dielectric blocks included in the three or more dielectric blocks, and the transmission line is electromagnetically coupled to the first dielectric block and the second dielectric block.

18. A communication device comprising:

a dielectric filter unit including three or more dielectric blocks including a first dielectric block and a second dielectric block, the three or more dielectric blocks being arranged adjacent to each other in a predetermined direction, and a transmission line, wherein the three or more dielectric blocks include at least one dielectric block between the first dielectric block and the second dielectric block, the three or more dielectric blocks each having closed end faces which are completely covered by a conductive layer, each of the three or more dielectric blocks is electromagnetically coupled to one or two adjacent dielectric blocks included in the three or more dielectric blocks, and the transmission line is electromagnetically coupled to the first dielectric block and the second dielectric block.

* * * * *